US006306233B1

(12) United States Patent
Zarzur

(10) Patent No.: US 6,306,233 B1
(45) Date of Patent: Oct. 23, 2001

(54) METHOD OF MANUFACTURING A TWO-THREAD YARN HAVING A CERTAIN DEGREE OF ELASTICITY FOR USE IN THE WEAVING INDUSTRY AND AN APPARATUS FOR CARRYING OUT SAID METHOD

(76) Inventor: Ivo Zarzur, Rua Estados Unidos, No. 970, Sao Paulo, 01427-001 (BR)

( * ) Notice: Subject to any disclaimer, the term of this patent is extended or adjusted under 35 U.S.C. 154(b) by 0 days.

(21) Appl. No.: 09/380,103

(22) PCT Filed: Dec. 4, 1998

(86) PCT No.: PCT/BR98/00100

§ 371 Date: Aug. 23, 1999

§ 102(e) Date: Aug. 23, 1999

(87) PCT Pub. No.: WO99/34046

PCT Pub. Date: Jul. 8, 1999

(30) Foreign Application Priority Data

Dec. 23, 1997 (BR) ..... 9706314

(51) Int. Cl.[7] ..... B32B 31/00

(52) U.S. Cl. ..... 156/148; 156/166; 57/225; 57/297; 442/184; 442/197; 442/199; 442/306

(58) Field of Search ..... 156/148, 166, 156/555; 57/225, 297; 442/184, 197, 199, 306

(56) References Cited

U.S. PATENT DOCUMENTS 3,945,186 * 3/1976 Van Dort ..... 156/166
5,186,779 * 2/1993 Tubbs ..... 156/161
5,687,587 11/1997 Michel .

FOREIGN PATENT DOCUMENTS 28 11 329 9/1979 (DE) .
37 23 902 A1 1/1989 (DE) .
44 45 384 A1 6/1996 (DE) .
2 045 821 11/1980 (GB) .
3-51335 * 3/1991 (JP) .
XP002099420 12/1992 (JP) .

OTHER PUBLICATIONS

Kunde, Klaus: "Elastomerverarbeitung auf Rundstrickmaschinen," *Melliand Textilberichte*, International Textile Reports, vol. 73, No. 10, Oct. 1, 1992, pp. 812–815.

* cited by examiner

*Primary Examiner*—Jeff H. Aftergut
(74) *Attorney, Agent, or Firm*—D. Peter Hochberg; Katherine R. Vieyra; William H. Holt

(57) ABSTRACT

The present invention refers to a method of manufacturing a two-thread yarn having a certain degree of elasticity for use on the weaving industry and to an apparatus for carrying out the method. The method comprises the steps of providing at least one elastic yarn and at least one support yarn as a paired couple; applying a water-soluble thermosetting adhesive substance to said elastic yarn and support yarn paired as a couple; fastening said adhesive-coated elastic yarn and support yarn paired as a couple to each other to form a two-thread yarn; and simultaneously stretching, heating and setting said two-thread yarn comprising said elastic yarn and said support yarn paired as a couple.

19 Claims, 2 Drawing Sheets

METHOD OF MANUFACTURING A TWO-THREAD YARN HAVING A CERTAIN DEGREE OF ELASTICITY FOR USE IN THE WEAVING INDUSTRY AND AN APPARATUS FOR CARRYING OUT SAID METHOD

BACKGROUND OF THE INVENTION

1. Technical Field of the Invention

The present invention refers to the weaving industry in general and, more specifically, to a method of manufacturing a two-thread yarn having a certain degree of elasticity for use in the weaving industry and to an apparatus for carrying out said method wherein a mono or multi-thread elastic yarn and a support yarn are fastened to each other, treated with a protective chemical film, dyed, stretched and set in order to provide a two-thread yarn having the desired elastic properties.

2. Description of the Prior Art

As it is widely known by those skilled in the art of weaving, since the first synthetic yarns were first developed approximately 50 years ago as a substitute for silk wool and cotton yarns, which production requires an extensive and rather lengthy process, the weaving industry has been trying to provide physical properties as close as possible to that of the natural yarns to these synthetic yarns.

With this purpose in mind, scientists in research and development centers all over the world have dedicated their efforts to combine the basic features of the synthetic yarns such as thickness, cross section, elasticity and others in order to provide a synthetic yarn which would result in a knitted or woven fabric having the same features of a fabric knitted or woven from a natural yarn.

A desirable feature of the fabrics manufactured from a synthetic yarn which can not be provided by a fabric made from 100% natural silk, wool or cotton yarn is a certain degree of elasticity, since these yarns have only a small amount of elasticity, if any.

However, providing a knitted or woven fabric having a precisely defined amount of elasticity is a difficult task, which has occupied the attention of researchers everywhere.

Presently, in order to provide a knitted or woven fabric having a certain degree of elasticity, typically an elastic yarn such as a mono or multi-filament elastic thread is used for knitting or weaving the fabric.

In the process of manufacturing a knitted fabric in a circular loom, said elastic yarn is typically used alone, that is, without being covered by a support yarn. In a circular loom the elastic yarn previously wound in bobbins is positioned in a feeding section of the loom and the elastic yarn is threaded with the support yarn made from a non-elastic material only at the entrance opening of the knitting needles. A typical circular loom has a capacity to handle approximately 90 bobbins of elastic and support yarns.

In the process of manufacturing a non-circular knitted fabric in an open warp loom, the elastic yarn is also used alone, that is, without being covered by a support yarn, the previously stretched elastic yarns being provided in bobbins. Approximately 1000 bobbins of the previously stretched elastic yarn are positioned in the feeding section of the loom and the elastic yarn is threaded with the support yarn in the knitting loom, the stretching of the elastic yarn being controlled by the feeding section.

Contrary to the above, when used in the process of manufacturing a woven fabric in an open warp loom, currently the elastic yarn is used only covered with a support yarn both as a warp thread to provide the resulting fabric with a certain degree of elasticity in its longitudinal direction, or as a weft thread in order to provide the fabric with a certain degree of elasticity in its transversal direction.

The use of an elastic yarn such as a mono or multi-filament elastic thread such as Lycra® for knitting or weaving a fabric having a certain degree of elasticity according to the state of the art, however, has the drawback that the cost of the resulting fabric is too expensive, due to the costs involved in manufacturing the covered elastic yarn in one case, and of the use of the elastic yarn alone, in the other.

An object of the present invention, therefore, is to solve this drawback of the prior art and it was with this problem in mind that the inventors of the present invention have developed the present method of manufacturing a two-thread yarn having a certain degree of elasticity for use in the weaving industry where a mono or multi-thread elastic yarn and a support yarn are fastened to each other, treated with a protective chemical film, dyed, stretched and set in order to provide a two-thread yarn having the desired elastic properties.

According to the present invention, the above and other objects and advantages are accomplished by the provision of a method of manufacturing a two-thread yarn having a certain degree of elasticity for use in the weaving industry comprising the steps of: providing at least one elastic yarn and one support yarn as a paired couple; applying a water-soluble thermosetting adhesive substance to said paired couple of yarns; fastening said adhesive coated paired couple of yarns to each other to form a two-thread yarn; and simultaneously stretching, heating and setting said elastic yarn and said support yarn paired as a couple to form the two-thread yarn.

According to a preferred embodiment of the present invention, said method additionally comprises the steps of applying a protective chemical film and a dyeing agent to the yarn while it is being fastened, drying the two-thread yarn comprised of said elastic yarn and support yarn, and of cooling the dried two-thread yarn after it leaves the drying chamber.

According to another aspect of the present invention, an apparatus for carrying out the method of manufacturing a two-thread yarn having a certain degree of elasticity for use in the weaving industry is also provided, said apparatus comprising: means for providing at least one elastic yarn and one support yarn as a paired couple; means for applying a water-soluble thermosetting adhesive substance to said paired couple of yarns; means for fastening said adhesive coated paired couple of yarns to each other to form a two-thread yarn; and means for simultaneously stretching, heating and setting said elastic yarn and said support yarn paired as a couple to form the two-thread yarn.

According to a preferred embodiment of the present invention, said apparatus additionally comprises means for applying a protective chemical film and a dyeing agent to the yarn while it is being fastened, a drying chamber for drying the elastic yarn and the support yarn paired as a couple forming the two-thread yarn and a cooling chamber to cool the dried two-thread yarn as it leaves the drying chamber.

The foregoing and other additional objects, features and advantages of the method for manufacturing a two-thread yarn for use in the weaving industry and of the apparatus for carrying out said method according to the present invention will be better understood by reference to the following detailed description, accompanied by schematic illustrations of the presently preferred embodiment of the invention, as shown in the attached drawings.

BRIEF DESCRIPTION OF THE DRAWINGS

The present invention will be described in greater detail hereinafter with specific reference to its presently preferred embodiment shown in the attached drawings, which are not in any way a limitation of the scope of the invention, and wherein.

BEST MODE FOR CARRYING OUT THE INVENTION

A preferred embodiment of the present invention is shown for illustrating purposes in the accompanying drawings and shall be described in details hereinafter. However, it is to be understood that while several variations and modifications of the present invention will become apparent to those skilled in the art, the present specification is not intended to limit the invention to the particular forms and/or dimensions described herein, but instead to cover all such modifications and alternate embodiments that may be within the spirit and scope of the invention as shown in the accompanying claims.

Figure 1:
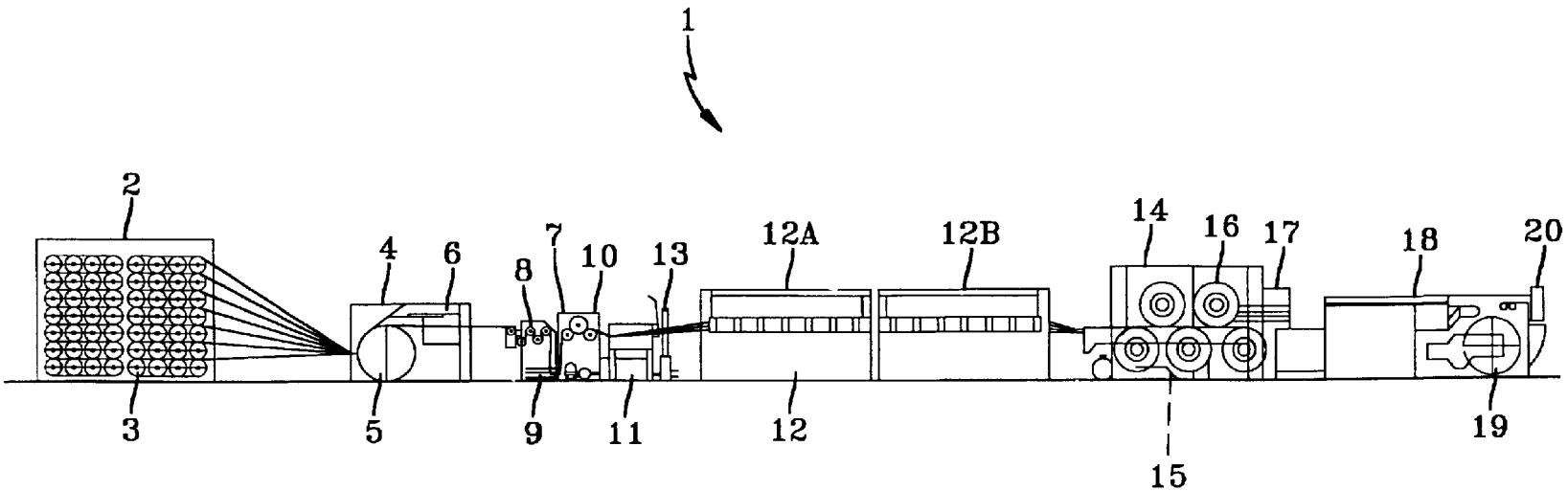
FIG. 1 shows a schematic representation of an apparatus for carrying out the method for manufacturing a two-thread yarn for use in the weaving industry according to the present invention.

With reference more particularly to the drawings, FIG. 1 is a schematic representation of the apparatus 1 for carrying out the method for manufacturing a two-thread yarn for use in the weaving industry according to the present invention.

The apparatus 1 comprises a feeding section 2 formed as a frame for supporting a number of yarn bobbins, with capacity for receiving up to 1200 yarn bobbins 3. For the purposes of the present invention, half of said yarn bobbins comprise an elastic yarn such as a mono or multi-filament elastic thread while the other half comprise a support yarn such as a POY yarn, which can be stretched up to 50% of its normal length.

A plurality of slack take-up mechanisms (not shown) comprising spinning wheels operating under a centralized control is provided in said feeding section 2, one for each yarn bobbin 3, in order to control the tension applied on each yarn by an unwinding chamber 4 which removes the yarns from the feeding section 2 or from a bobbin of yarns 5 to form paired couples of yarns comprising an elastic yarn and a support yarn each. Said unwinding chamber 4 reciprocates over rails in order to allow the yarns to be directly fed from said feeding section 3 or said bobbin 5 under a desired tension.

A coating of a water-soluble thermosetting adhesive substance is applied to said elastic yarn and support yarn paired as a couple at the unwinding chamber 4, as they pass through an immersion bath 6 containing said adhesive substance in order to allow the fastening of the elastic yarn to the support yarn at a latter step to form a two-thread yarn that will be further treated according to the method of the present invention.

The adhesive coated elastic yarn and support yarn paired as a couple are subsequently fed to a fastening and dyeing chamber 7, where a protective chemical film and a dyeing agent are simultaneously applied to the elastic yarn and support yarn paired as a couple by passing said yarns through an immersion bath 9, said dyeing agent being applied in combination with a dispersing agent. It shall be noticed that applying a dyeing agent to the yarns is not a requirement, and that in some cases the final use of the two-thread yarn may not require the use of a color.

The elastic yarn and support yarn paired as a couple are fastened to each other at the entrance of the fastening and dying chamber 7 by passing over rolls 8 in order to ensure their fastening. An anti-foaming device (not shown) is provided in said fastening and dying chamber 7 in order to avoid the forming of foam over the external surface of the yarns.

Also, after being fastened and dyed, the two-thread yarn comprised of said elastic yarn and support yarn is passed through pressure rolls 10, each provided with individual driving motors and with means for controlling the pressure applied to the two-thread yarn as a function of the rotating speed of the rolls, comprising a proportional valve establishing a linear variation of the pressure as a direct function of the speed of said rolls 10.

After applying the protective chemical film to the two-thread yarn comprised of said elastic yarn and support yarn, the yarn is fed to a cleaning chamber 11 where the different two-thread yarns are separated from one another through refrigerated rotating bars, said bars rotating in order to avoid any possible accumulation of the protective chemical film over the same and to separate the yarns in layers at the entrance of the stretching, heating and setting chamber 12.

A sensor 13, typically a laser emitter and receptor is positioned at the exit of the cleaning chamber 11 before the two-thread yarns are fed to the stretching, heating and setting chamber 12 to detecting any possible disruption in the yarn. Said sensor 13 being connected to a central control and being able to stop the operation of the apparatus should any disruption be detected in order to allow the required time for correcting the disruption without losing the extremities of the yarns, even at speeds of 500 m/min.

The stretching, heating and setting chamber 12 comprises two individual heating sections 12A, 12B each designed to provide a substantially uniform distribution of the flow of air within each chamber, a constant temperature and high stretching, heating and setting efficiency, the latter due to an effective control of the relative humidity of the air circulating within each chamber. Chamber 12A being provided with an exhaust for the saturated air.

Chambers 12A, 12B are heated to a temperature of approximately 200° C. through a system which forces the circulation of heated thermal oil, in order to allow the two-thread yarn comprised of said elastic yarn and support yarn to be stretched to over 100%, preferably from at least 150% to 300% of its original length and also to allow the polymerization of the polyester used as dyeing agent due to the temperature of the heating zone.

The simultaneous stretching, heating and setting of the two-thread yarn comprised of said elastic yarn and support yarn results in the desired degree of elasticity of the final product. This is due to the fact that while the elastic yarn has a tendency to contract proportional to the stretching to which it was submitted, the support yarn does not have this tendency, and the setting of the water-soluble adhesive substance fastening the two yarns does not allow the elastic yarn to contract.

After the two-thread yarn is used to produce a knitted or woven fabric at a latter step, washing the fabric dissolves the water-soluble adhesive substance, allowing the elastic yarn to separate from the support yarn and to contract to its original length, providing the fabric with the desired degree of elasticity.

After being stretched, heated and set in chamber 12, the two-thread yarn is fed to a drying chamber 14 where it is passed over a drying rolls assembly comprising five drying rolls 15 driven by an electric motor and each provided with individual temperature controllers. The provision of an electric driving motor for the drying rolls 15 and for the pressure rolls 10 allows a precise control of the stretching applied to the yarns due to the difference in the speed at which each set of rolls is rotating.

A wobbling roll 16 is provided at the exit of the drying chamber 14, said wobbling roll 16 measuring and monitoring the traction being applied to the two-thread yarns in order to allow said yarns to be wound with a desired tension. A system for measuring the residual humidity of the two-thread yarns is also provided in said wobbling roll 16.

The wobbling roll 16 works under pneumatic pressure, and with the distributing head measures the tension applied to the two-thread yarns and actuates electronically in order to maintain a constant tension on said yarns at any working speed.

Additionally, a lubricating spool 17 is provided at the exit of the drying chamber 14 in order to apply a certain amount of lubricating oil to the two-thread yarns. The lubricating oil helps enhancing the performance of the two-thread yarns when subsequently used in a loom.

A cooling chamber 16 having a winding roll 19 is provided at the final end of the apparatus, said cooling chamber 18 helping avoid the two-thread yarns from adhering to each other when high speeds are used while allowing the two-thread yarns manufactured according to the method of the present invention to be wound without the risk of causing any damages to the yarns.

A microcomputer 20 controls the operation of the apparatus 1, said microcomputer 20 receiving the signals fed from sensors positioned along the apparatus and responding to the received signals to correct any detected problem.

Figure 2:
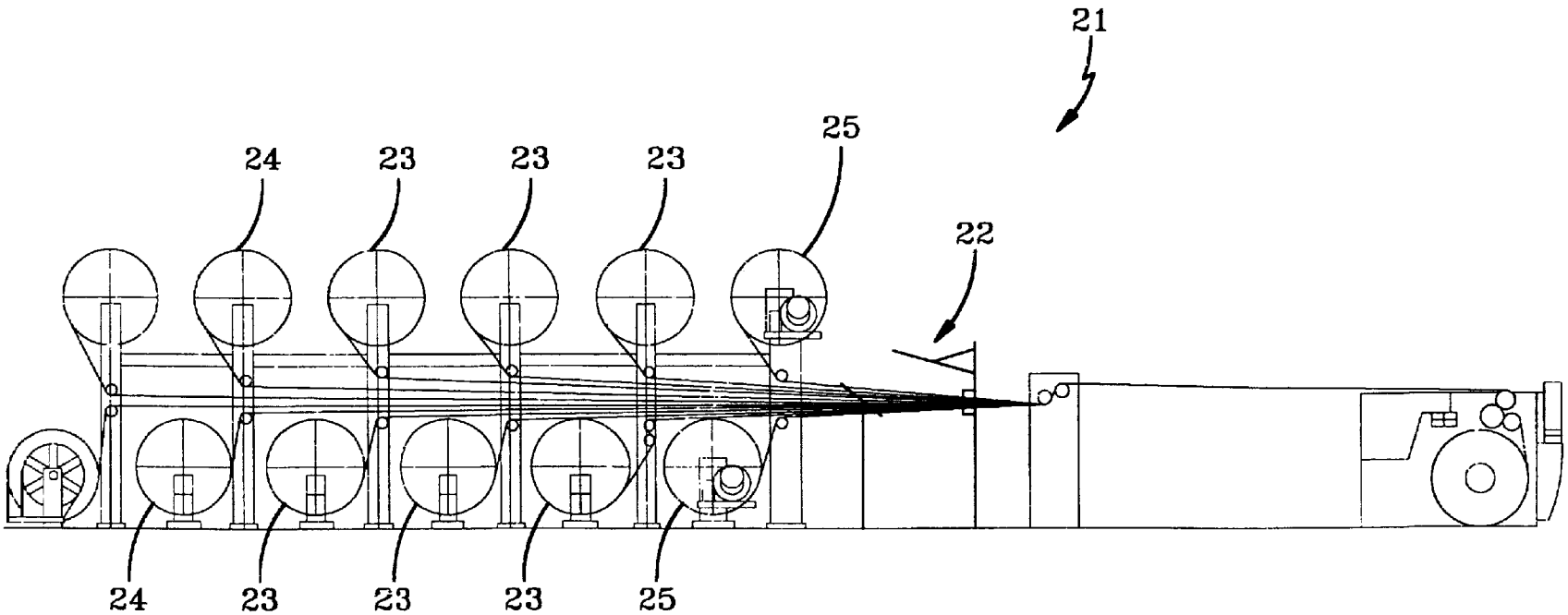
FIG. 2 is a view illustrating the apparatus for winding the two-thread yarns.

FIG. 2 is a schematic representation of the apparatus for winding the two-thread yarns manufactured according to the method of the present invention, in order to provide a final bobbin for use in a loom having a desired number of yarns.

The winding apparatus 21 is a frame 22 providing ten positions for receiving winding rolls 23, each position having an electronically operated pneumatic braking system associated therewith, two additional positions for driven rolls 24 to wind the elastic yarn under a certain tension, and a winding head 25 for the two-thread yarns.

Each of said rolls is individually driven by an electric motor controlled by said microcomputer 20, in order to allow the winding of the yarns under tension, to enhance its performance when used in a loom.

The apparatus for carrying out the method of manufacturing a two-thread yarn having a certain degree of elasticity according with the present invention also allow a step by step operation, using the distributing head to dye a bobbin of support yarn and latter, in a separate second step, fasten it to the elastic yarn. It is also possible to use the apparatus with POY yarns totally stretched from the feeding apparatus or from the distributing head in order to dye or to apply the protective chemical film.

Nominal values with a linear scale variation can be set for all controllers programmed by the coupled microcomputer, as well as the possibility of establishing admissible operational tolerances for each of the parameters involved. Electronic controllers are provided for controlling the tension of the yarn, the pressure applied by the foulard in the chamber where the protective chemical film and the dye are applied to the yarn, the yarn stretching station, the temperatures, the relative humidity of the air in chambers TA and TB, the post-lubricating system, the detection of the residual humidity of the yarn at the exit, the coolers, the bath feeding, the detection of the amount of solids applied to the yarns, and other parameters. Also, a multimedia system can be used in connection with the apparatus in order to allow a control of the manufacturing method by an operator, through the use of a recorded human voice.

The present invention has been described and illustrated in connection with a presently preferred method and apparatus for carrying it out, however, those skilled in the art will readily understand that other modifications and variations may be resorted to without departing from the spirit and scope of the invention. Such modifications and variations are considered to be within the purview and scope of the invention as defined in the accompanying claims.

What is claimed is:

1. A method of manufacturing a two-thread yarn having a certain degree of elasticity for use in weaving comprising the steps of:

providing at least one elastic yarn and at least one support yarn as a paired couple;

applying a water-soluble thermosetting adhesive substance to said elastic yarn and support yarn paired as a couple;

fastening said adhesive-coated elastic yarn and support yarn paired as a couple to each other to form a two-thread; and simultaneously stretching, heating and setting said two-thread yarn comprising said elastic yarn and said support yarn paired as a couple.

2. The method as defined in claim 1, wherein said step of providing said at least one elastic yarn comprises the provision of a mono or multi-filament thread having elastic properties.

3. The method as defined in claim 2, wherein said step of providing said at least one elastic yarn comprises the provision of a yarn of synthetic fibers and filaments for generalized use in the industrial arts.

4. The method as defined in claim 1, wherein said support yarn is a yarn that can be stretched but will not recoil to its original length.

5. The method as defined in claim 1, wherein said step of applying a water-soluble thermosetting adhesive substance to said elastic yarn and support yarn paired as a couple comprises immersing the paired yarns in a bath of said adhesive substance.

6. The method as defined in claim 1, wherein said step of fastening said adhesive coated elastic yarn and support yarn paired as a couple to each other to form a two-thread yarn comprise passing the paired yarns over pressure rolls.

7. The method as defined in claim 1, wherein said step of simultaneously stretching, heating and setting said two-thread yarn comprises the use of stretching rolls rotating at different speeds within a heated chamber.

8. The method as defined in claim 1, additionally comprising the step of applying a protective chemical film and a dyeing agent to the yarn while it is being fastened.

9. The method as defined in claim 1, additionally comprising the step of drying said two-thread yarn comprised of said elastic yarn and support yarn.

10. The method as defined in claim 9, wherein said step of drying said two-thread yarn comprised of said elastic yarn and support yarn comprises passing said two-thread yarn through a drying assembly in a drying chamber.

11. The method as defined in claim 10, additionally comprising the step of cooling the two-thread yarn comprised of said elastic yarn and support yarn as it leaves the drying chamber.

12. The method as defined in claim 11, wherein said step of cooling the two-thread yarn comprised of said elastic yarn and support yarn comprises passing said two-thread yarn through a cooling chamber.

13. The method as defined in claim 10, additionally comprising the step of monitoring tension applied to the two-thread yarn comprised of said elastic yarn and support yarn as it leaves the drying chamber.

14. The method as defined in claim 1, additionally comprising the step of monitoring physical integrity of said elastic yarn and support yarn paired as a couple as they leave a fastening chamber.

15. The method as defined in claim 1, wherein the step of providing the elastic yarn and the support yarn includes a feeding section including a frame and a number of yarn bobbins form which said elastic yarn and said support yarn are fed.

16. The method as defined in claim 15, wherein said feeding section comprises a slack take-up mechanism to control tension applied on each yarn connected to each yarn bobbin.

17. The method as defined in claim 16, wherein each slack take-up mechanism comprises a spinning wheel operating under a centralized control.

18. The method as defined in claim 1, wherein said step of fastening said adhesive coated elastic yarn and support yarn paired as a couple to each other to form a two-thread yarn includes a fastening chamber.

19. The method as defined in claim 18, wherein said elastic yarn and support yarn paired as a couple are fastened to each other at an entrance of the fastening chamber by passing over pressure rolls.

* * * * *